US011466500B2

(12) United States Patent
Meurer

(10) Patent No.: US 11,466,500 B2
(45) Date of Patent: Oct. 11, 2022

(54) ARRANGEMENT OF A DRIVE DEVICE ON A DOOR FOR AN APPLIANCE, PARTICULARLY FOR A COOLING AND/OR REFRIGERATING APPLIANCE

(71) Applicant: Apparatebau Gronbach S.r.l., Laag / Neumarkt (IT)

(72) Inventor: Gerold Meurer, Margreid (IT)

(73) Assignee: Apparatebau Gronbach S.r.l., Laag/Neumarkt (IT)

( * ) Notice: Subject to any disclaimer, the term of this patent is extended or adjusted under 35 U.S.C. 154(b) by 264 days.

(21) Appl. No.: 16/755,413

(22) PCT Filed: Oct. 17, 2017

(86) PCT No.: PCT/IT2017/000228
§ 371 (c)(1),
(2) Date: Apr. 10, 2020

(87) PCT Pub. No.: WO2019/077636
PCT Pub. Date: Apr. 25, 2019

(65) Prior Publication Data

US 2020/0256110 A1 Aug. 13, 2020

(51) Int. Cl.
*E05F 15/622* (2015.01)
*E05F 3/22* (2006.01)
*F25D 23/02* (2006.01)

(52) U.S. Cl.
CPC ..... *E05F 15/622* (2015.01); *E05F 3/22* (2013.01); *F25D 23/028* (2013.01);
(Continued)

(58) Field of Classification Search
CPC .... E05F 15/622; E05F 3/22; E05Y 2201/604; E05Y 2900/31; F25D 23/028; F25D 2323/024
See application file for complete search history.

(56) References Cited

U.S. PATENT DOCUMENTS 10,648,218 B1 * 5/2020 Schroeder ..... E05F 3/18
2008/0202885 A1 8/2008 Rhodes et al.
(Continued)

FOREIGN PATENT DOCUMENTS

CN 2881024 Y 3/2007
CN 201015526 Y 2/2008
(Continued)

OTHER PUBLICATIONS

CNIPO; App. No. 201780097777.6; First Office Action and Search Report dated May 19, 2021.
(Continued)

*Primary Examiner* — Daniel J Rohrhoff
(74) *Attorney, Agent, or Firm* — Fitch, Even, Tabin & Flannery LLP

(57) ABSTRACT

The invention relates to an arrangement of a drive device on a door that can be arranged such that it is pivotable on a housing of an appliance, particularly a cooling and/or refrigerating appliance, in which the drive device designed to pivot the door in relation to the housing is mounted on the door, said drive device comprising: a hinge comprising at least one first hinge part attached to the door and at least one second hinge part which is attached to the housing; at least one drive motor; at least one transmission element which is coupled to the hinge in an at least indirectly articulated manner and can be at least indirectly driven by means of the drive motor; and a coupling device that can switch between at least one coupling state in which the transmission element is coupled to the drive motor and at least one uncoupling state.

15 Claims, 10 Drawing Sheets

(52) U.S. Cl.
CPC ..... *E05Y 2201/604* (2013.01); *E05Y 2900/31* (2013.01); *F25D 2323/024* (2013.01)

(56) References Cited

U.S. PATENT DOCUMENTS

| | | | | |
|---|---|---|---|---|
| 2009/0160297 | A1* | 6/2009 | Anikhindi | F25D 25/025 312/319.7 |
| 2010/0018122 | A1* | 1/2010 | Hecht | E05F 15/619 49/31 |
| 2010/0141107 | A1* | 6/2010 | Kim | F25D 23/028 49/31 |
| 2017/0284144 | A1* | 10/2017 | Yasaka | F25D 23/028 |
| 2017/0298674 | A1* | 10/2017 | Vanini | A47L 15/4261 |
| 2018/0245391 | A1* | 8/2018 | Margonari | F24C 15/023 |
| 2018/0283077 | A1* | 10/2018 | Lee | E05D 3/16 |
| 2018/0334846 | A1* | 11/2018 | Eom | F25D 23/028 |
| 2020/0263479 | A1* | 8/2020 | Lee | F25D 23/02 |
| 2021/0025214 | A1* | 1/2021 | Dora | E05F 15/622 |
| 2021/0389048 | A1* | 12/2021 | Murata | F25D 29/005 |
| 2021/0396300 | A1* | 12/2021 | Inagaki | F16H 25/2021 |
| 2022/0025692 | A1* | 1/2022 | Henes | E05F 15/614 |

FOREIGN PATENT DOCUMENTS

| | | | | |
|---|---|---|---|---|
| CN | 201507195 | U | 6/2010 | |
| CN | 103437628 | A | 12/2013 | |
| CN | 205314773 | U | 6/2016 | |
| CN | 105756453 | A | 7/2016 | |
| CN | 105971439 | A | 9/2016 | |
| DE | 202020104182 | U1 * | 9/2020 | E05F 1/1261 |
| EP | 2148035 | A2 | 1/2010 | |
| KR | 20060106341 | A | 10/2006 | |
| WO | 2016000465 | A1 | 1/2016 | |

OTHER PUBLICATIONS

PCT; App. No. PCT/IT2017/000228; International Search Report and Written Opinion dated Sep. 10, 2018.
CNIPA; Application No. 2017800977776; Office Action dated Dec. 16, 2021. (in Chinese with English translation).

* cited by examiner

ARRANGEMENT OF A DRIVE DEVICE ON A DOOR FOR AN APPLIANCE, PARTICULARLY FOR A COOLING AND/OR REFRIGERATING APPLIANCE

CROSS-REFERENCE TO RELATED APPLICATIONS

This application is a U.S. national phase application of International Application No. PCT/IT2017/000228, filed Oct. 17, 2017, designating the United States.

FIELD

The invention relates to an arrangement of a drive device on a door for an appliance, in particular for a cooling and/or refrigerating appliance, according to the respective preamble of claims 1, 10 and 13.

BACKGROUND

EP 2 148 035 A2 discloses an arrangement with a housing, in particular of a cooling and/or refrigerating appliance. The arrangement further includes a door pivotably hinged to the housing around a pivot axis of a hinge and at least one drive device for pivoting the door with respect to the housing. Therein, the drive device includes a drive unit, by means of which a torque can be exerted on the door with respect to the hinge axis via at least one force transmitting means.

It is the object of the present invention to provide an arrangement of a drive device on a door for an appliance, in particular for a cooling and/or refrigerating appliance, such that the door can be pivoted in particularly advantageous manner.

SUMMARY

According to the invention, this object is solved by an arrangement with the features of claim 1, by an arrangement with the features of claim 10 as well as by an arrangement with the features of claim 13. Advantageous configurations with convenient developments of the invention are specified in the remaining claims.

A first aspect of the invention relates to an arrangement of a drive device on a door for the appliance, capable of being pivotably arranged on a housing of an appliance, in particular of an electrical or electronic appliance and therein preferably a cooling and/or refrigerating appliance. In the arrangement, the drive device is retained on the door, wherein the door is pivotable in relation to the housing of the appliance by means of the drive device. In other words, the drive device is formed for pivoting the door in relation to the housing.

Therein, the drive device includes a hinge, which comprises at least one first hinge part attached to the door and at least one second hinge part attachable or attached to the housing, which is coupled to the first hinge part in articulated manner, in particular at least in indirect manner. The drive device further includes at least one drive motor, which is preferably formed as an electric motor and thus is operable in electrical manner or by means of electrical energy or electrical current.

The drive device further includes at least one transmission element at least indirectly coupled to the hinge, in particular to one of the hinge parts, in articulated manner, which is at least indirectly drivable for pivoting the hinge parts in relation to each other by means of the drive motor and thereby rectilinearly or linearly and thus translationally movable in relation to the door to thereby pivot the door in relation to the housing. In other words, the drive motor can at least indirectly drive the transmission element and thereby rectilinearly or linearly move it in relation to the door, whereby the door is pivotable in relation to the housing. Again expressed in other words, the drive motor can effect a rectilinear or linear movement of the transmission element in relation to the door, whereby the door is pivotable in relation to the housing by means of the drive motor via the transmission element. Thus, the door is pivotable in relation to the housing by motor such that manual pivoting of the door can for example be omitted. In particular, it is conceivable that the door is pivotable in relation to the housing by means of the drive motor via the transmission element and can thereby be closed and/or opened.

Moreover, the drive device includes a coupling device, which is switchable, in particular movable, between at least one coupling state and at least one uncoupling state. In the coupling state, the transmission element is coupled to the drive motor, in particular via the coupling device, such that the transmission element is for example drivable by means of the drive motor and thereby rectilinearly movable in relation to the door in the coupling state of the coupling device. Thus, the door can for example be pivoted in relation to the housing via the transmission element and the coupling device by means of the drive motor. In the uncoupling state of the coupling device, the transmission element is uncoupled from the drive motor such that a force fit or a force or torque flow between the drive motor and the transmission element is for example interrupted. Hereby, the drive motor cannot drive the transmission element in the uncoupling state such that the door cannot be pivoted in relation to the housing by means of the drive motor in the uncoupling state.

Again expressed in other words, a force or torque transmission path between the door and the drive motor, in particular via the transmission element and the coupling device, is for example closed in the coupling state such that forces or torques can for example be transmitted between the door and the drive motor via the force or torque path. However, in the uncoupling state, the force or torque transmission path is interrupted such that forces or torques cannot be transmitted between the door and the drive motor in the uncoupling state. As a result, it is for example possible that the door can be manually pivoted in relation to the housing by a person in the uncoupling state without the drive motor being herein driven by the door.

In the uncoupling state, an influence of the drive motor on manually pivoting the door in relation to the housing can thus be avoided such that the door can be particularly simply and comfortably manually pivoted in relation to the housing and thus for example be opened and/or closed in the uncoupling state. For example, this is advantageous upon failure of the drive motor since the door can then for example be manually pivoted in relation to the housing by a person in simple and comfortable manner upon failure of the drive motor, that is if the door can no longer be pivoted by motor in relation to the housing by means of the drive motor. Hereto, the coupling device is for example simply adjusted or switched from the coupling state into the uncoupling state.

Now, in order to be able to couple the door or the transmission element to the drive motor and to be able to uncouple it from the drive motor in particularly advantageous and adequate manner, it is provided according to the invention that the coupling device comprises at least one coupling actuator provided in addition to the drive motor. The coupling actuator is for example an electrically operable actuator and thus for example formed as a further electric motor. Furthermore, it is provided according to the invention that the coupling device comprises at least one coupling element, which is movable in relation to the door between at least one coupling position effecting the coupling state and at least one uncoupling position effecting the uncoupling state by means of the coupling actuator and thus for example independently of the drive motor. This means that the coupling state corresponds to the coupling position of the coupling element since for example in the coupling position, in which the coupling state is set, the door or the transmission element is coupled to the drive motor via the coupling element. The uncoupling position corresponds to the uncoupling state such that the uncoupling state is set by moving the coupling element into the uncoupling position.

Since the coupling actuator is provided in addition to the drive motor, a redundancy is provided since the coupling element can always be moved between the coupling position and the uncoupling position also by means of the coupling actuator and thus in particularly adequate and comfortable manner upon failure of the drive motor.

It has proven particularly advantageous if the first coupling element movable in relation to at least one second coupling element of the coupling device by means of the actuator cooperates with the corresponding second coupling element in form-fit manner in the coupling position such that the transmission element is at least form-fit coupled to the drive motor, in particular via the coupling elements, in the coupling state or in the coupling position. By the form-fit coupling of the transmission element to the drive motor, a particularly efficient and effective force or torque transmission can be realized such that the door can be pivoted in relation to the housing by means of the drive motor in particularly effective and efficient manner and in particular also with high forces or torques provided by the drive motor.

In order to be able to realize a particularly advantageous and in particular efficient and effective pivoting of the door in relation to the housing, it is provided in further configuration of the invention that the transmission element is formed as a threaded nut, which comprises an internal thread as a first thread. Therein, the drive device comprises a threaded spindle corresponding to the threaded nut, which comprises an external thread corresponding to the internal thread as a second thread and is drivable by means of the drive motor and thereby rotatable around a rotational axis in relation to the door and in relation to the threaded nut. The threaded nut can for example be arranged or is arranged on the threaded spindle. In particular, the threaded nut can for example be or is screwed onto the threaded spindle. In the state of the threaded nut arranged on the threaded spindle or in the state of the threaded nut screwed onto the threaded spindle, the threads cooperate in form-fit manner or the threads engage with each other.

For example, if the threaded spindle is then rotated around the mentioned rotational axis in relation to the door by means of the drive motor, while the threaded nut is supported against a rotation resulting from the rotation of the threaded spindle, thus, the threaded spindle is also rotated around the rotational axis in relation to the threaded nut. Such a relative rotation between the threaded spindle and the threaded nut is converted into a rectilinear or linear movement of the threaded nut along the threaded spindle by means of the threads and therein with form-fit cooperation of the threads such that the threaded nut rectilinearly or linearly moves along the threaded spindle and therein in relation to the threaded spindle in that the threaded spindle is rotated around the rotational axis in relation to the threaded nut in the described manner. In other words, the threaded nut is rectilinearly movable along the threaded spindle with form-fit cooperation of the threads in that the threaded spindle is rotated around the rotational axis in relation to the threaded nut. Hereby, particularly high forces or torques can also be transmitted from the drive motor to the door via the threaded spindle and the threaded nut in efficient and effective manner such that the door can also be particularly advantageously moved by means of the drive motor if the door has large exterior dimensions and/or a high weight.

In order to therein be able to keep the number of parts, the weight, the cost and the installation space requirement of the drive device and the arrangement overall particularly low and therein to be able to realize a particularly advantageous coupling and uncoupling of the transmission element with the drive motor at the same time, it is provided in further configuration of the invention that the threaded nut comprises at least two nut elements forming at least respective parts of the internal thread and movable in relation to each other, wherein at least one of the nut elements is formed as the first coupling element and the threaded rod is formed as the second coupling element. This means that at least the one nut element can be moved in relation to the threaded spindle by means of the coupling actuator, whereby the transmission element and thus the door can be particularly adequately coupled to the threaded spindle and thus to the drive motor and uncoupled from the threaded spindle and thus from the drive motor.

In the coupling position, the part of the internal thread formed by the one nut element cooperates with the external thread in form-fit manner such that at least the one nut element or the threaded nut can be rectilinearly moved by rotating the threaded spindle in the coupling position to thereby effect pivoting of the door. However, in the uncoupling position, the part of the internal thread formed by the one nut element does not cooperate with the threaded spindle or with the external thread thereof, whereby the previously mentioned force or torque transmission path is for example interrupted.

Therein, it is for example in particular provided that the hinge or the door is at least coupled to the one nut element, in particular in articulated manner. Thus, if the one nut element is in the uncoupling position, thus, the hinge and thus the door are uncoupled from the threaded spindle and thus from the drive motor. However, if the at least one nut element is in the coupling position, thus, the hinge and thus the door are coupled to the threaded spindle and thus to the drive motor in form-fit manner via the one nut element.

A further embodiment is characterized in that at least one angle sensor is provided, by means of which respective rotational positions of the threaded spindle can be captured. Based on the captured rotational positions, it is possible to capture respective pivot positions of the door, whereby the door can be particularly precisely and adequately pivoted by means of the drive motor.

Alternatively or additionally, at least one linear sensor is provided, by means of which respective linear positions of the threaded nut along the threaded spindle can be captured. Based on the linear positions, respective pivot positions of the door can be captured such that the door can be particularly precisely pivoted and in particular moved into respective pivot positions.

In particular, an electronic computing device is for example provided, which is also referred to as control device. The angle sensor and the linear sensor, respectively, for example each provide at least one, in particular electrical, signal, which characterizes the respective captured rotational positions and linear positions, respectively. The signal is for example received by means of the electronic computing device, which for example controls the drive motor depending on the received signal and thus depending on the rotational positions and linear positions, respectively. Hereby, the drive motor is operated depending on the signal and thus depending on the rotational positions and linear positions, respectively, such that the door can be specifically pivoted depending on the signal by means of the electronic computing device via the drive motor.

In order to be able to particularly advantageously pivot and in particular particularly advantageously open the door, an opening aid is provided in further configuration of the invention, which comprises at least one opening element. The opening element is pivotable in relation to the door and in relation to the housing into supporting abutment on the housing to thereby repel the door from the housing and thereby pivot it from a closed position into an open position. This embodiment is based on the realization that in particular the initial opening of the door requires high force or high torque, which would have to be provided by the drive motor if the opening aid was not provided. In particular, pivoting the door from the closed position into the open position is to be understood by this initial opening. The torque particularly high for initially opening the door or the high force required for initially opening the door in particular results from the fact that for example if the door is first opened, warm air from an environment of the appliance for example formed as a cooling and/or refrigerating appliance can flow into at least one cavity of the appliance at least partially, in particular at least predominantly or completely, closable by means of the door. The cavity is for example a cooling and/or refrigerating space, in which objects and/or food can be cooled and/or frozen. If the door is closed thereupon, thus, the initially warm air flown into the cavity can cool down, wherefrom a negative pressure existing in the cavity results. This negative pressure is a first pressure, which is lower than a second pressure existing in the environment of the appliance and the door.

By the use of the opening aid, the initial opening of the door can be realized by means of the opening aid. A further opening of the door effected starting from the open position can for example be effected by means of a low torque or by means of a low force. Thereby, the weight and the power requirement, the cost and the installation space requirement of the drive motor can for example be kept particularly low.

In order to be able to keep the number of parts, the weight, the installation space requirement and the cost particularly low, it is provided in further configuration of the invention that the opening element is rotationally fixedly connected to the drive motor, wherein the drive motor and the opening element are rotatable in relation to the door, in particular within certain limits, and rotate into a rotational direction in relation to the door upon pivoting the door into the open position to be effected by means of the torque provided by the drive motor such that the opening element comes into supporting abutment on the housing, whereupon the torque provided by the drive motor can be supported on the housing via the opening element to thereby pivot the door into the open position by means of the torque. In other words, in order to for example open the door first being in the closed position and therein in particular move it into the open position, the drive motor provides the mentioned torque. The torque is for example supported on the door, in particular via the transmission element, and for example on the housing via the door on the one hand, wherein the torque is for example initially not supported on the other hand in that the drive motor and the opening element are rotatable in relation to the door. This results in a rotation of the drive motor and the opening element rotationally fixedly connected to the drive motor in relation to the door, in particular until the opening element comes into supporting abutment on the housing. If the drive motor then further provides the torque, thus, the torque is supported on the housing or transmitted to the housing via the opening element. If the drive motor further provides the torque, thus, a further relative rotation of the drive motor and the opening element into the rotational direction in relation to the door and in relation to the housing occurs, whereby the door is repelled from the housing via the drive motor and the opening element and thereby moved into the open position.

In order to thereupon be able to particularly advantageously for example further open the door starting from the open position, at least one stop is provided on the door in further configuration of the invention, wherein the drive motor and the opening element rotate further into the rotational direction in relation to the door upon further or continued provision of the torque occurring after the pivoting of the door into the open position effected by means of the torque, such that the opening element—after it has been moved into supporting abutment on the housing and the door was thereby repelled from the housing—comes into supporting abutment on the stop, whereupon the torque provided by the drive motor can be or is supported on the stop, whereby the door can be further opened or is further opened starting from the open position by means of the torque.

In order to be able to particularly advantageously initially open the door, it is provided in further configuration of the invention that the opening element is formed as a cam, that is as an opening cam.

A second aspect of the invention relates to an arrangement of a drive device on a door capable of being pivotably arranged on a housing of an appliance, in particular of a cooling and/or refrigerating appliance, in which the drive device formed for pivoting the door in relation to the housing is retained on the door. Therein, the drive device includes a hinge, which comprises at least one first hinge part attached to the door and at least one second hinge part attachable or attached to the housing and coupled to the first hinge part in articulated manner. Further, the drive device includes at least one drive motor, by means of which at least one torque for pivoting the door can be provided. The drive device further includes a transmission element at least indirectly coupled to the hinge part in articulated manner, which is drivable for pivoting the hinge parts in relation to each other by means of the torque provided by the drive motor and is thereby rectilinearly or linearly movable in relation to the door to thereby pivot the door in relation to the housing.

Furthermore, the drive device includes an opening aid, which comprises at least one opening element, which is pivotable in relation to the door and the housing into supporting abutment on the housing, to thereby repel the door from the housing and thereby pivot it from a closed position into an open position.

Now, in order to be able to particularly advantageously and in particular effectively and efficiently, in particular initially, open the door, it is provided in the second aspect of the invention that the opening element is rotationally fixedly connected to the drive motor, wherein the drive motor and the opening element are rotatable in relation to the door and rotate into a rotational direction in relation to the door upon pivoting the door into the open position to be effected by means of the torque provided by the drive motor such that the opening element, in particular first, comes into supporting abutment on the housing, whereupon the torque provided by the drive motor can be supported on the housing via the opening element, to thereby pivot the door into the open position by means of the torque. Advantages and advantageous configurations of the first aspect of the invention are to be regarded as advantages and advantageous configurations of the second aspect of the invention and vice versa.

In order to be able to further move, in particular open, the door in particularly advantageous and in particular effective and efficient manner starting from the open position, it is provided in an advantageous configuration of the second aspect of the invention that at least one stop is provided on the door, wherein the drive motor and the opening element further rotate into the rotational direction in relation to the door upon further providing the torque occurring after pivoting the door into the open position effected by means of the torque such that the opening element comes into supporting abutment on the stop, whereupon the torque provided by the drive motor can be supported or is supported on the stop, whereby the door can be or is further opened starting from the open position by means of the torque.

In a particularly advantageous embodiment of the invention, the opening element is formed as a cam, whereby a particularly advantageous torque or force transmission from the opening element to the housing can be realized. Hereby, the door can be particularly advantageously initially opened, wherein the power requirement, the weight and the installation space requirement of the drive motor can be kept particularly low at the same time.

A third aspect of the invention relates to an arrangement of a drive device on a door capable of being pivotably arranged on a housing of an appliance, in particular of a cooling and/or refrigerating appliance, in which the drive device formed for pivoting the door in relation to the housing is retained on the door and thus can be pivoted with the door in relation to the housing. Therein, the drive device includes a hinge, which comprises at least one first hinge part attached to the door and at least one second hinge part attachable or attached to the housing and coupled to the first hinge part in articulated manner. Moreover, the drive device includes at least one drive motor as well as a transmission element at least indirectly coupled to the hinge in articulated manner, which is at least indirectly drivable for pivoting the hinge parts in relation to each other by means of the drive motor and thereby is rectilinearly movable in relation to the door to thereby pivot the door in relation to the housing.

Now, in order to be able to particularly advantageously pivot the door in particular even if the door has large exterior dimensions and/or a high weight, it is provided in the third aspect of the invention that the transmission element is formed as a threaded nut, which comprises an internal thread as a first thread. Furthermore, the drive device includes a threaded spindle corresponding to the threaded nut, which comprises an external thread corresponding to the internal thread as a second thread and is drivable by means of the drive motor and thereby rotatable around a rotational axis in relation to the door and in relation to the threaded nut, whereby the threaded nut is rectilinearly movable along the threaded spindle and in particular in relation to the threaded spindle with form-fit cooperation of the threads. Advantages and advantageous configurations of the first aspect of the invention and of the second aspect of the invention are to be regarded as advantages and advantageous configurations of the third aspect of the invention and vice versa.

In order to be able to particularly precisely and thus particularly advantageously pivot the door by motor, at least one angle sensor is provided in an embodiment of the third aspect of the invention, by means of which respective rotational positions of the threaded spindle can be captured.

A further embodiment is characterized in that at least one linear sensor is provided, by means of which respective linear positions of the threaded nut along the threaded spindle can be captured.

A fourth aspect of the invention relates to an appliance, in particular an electrical or electronic appliance, which is for example formed as a refrigerating and/or cooling appliance. The appliance according to the invention includes at least one arrangement according to the invention such that the door is pivotably retained on the housing in the appliance according to the invention. In other words, the appliance according to the invention includes the previously mentioned housing and the respective arrangement.

In a fifth aspect of the invention, the opening aid for example includes an opening aid actuator provided in addition to the drive motor, by means of which a tappet is for example at least translationally movable along an opening direction, in particular in relation to the door. Therein, the tappet comprises a first surface extending obliquely to the opening direction. Therein, the opening element for example comprises a second surface extending obliquely to the opening direction. The first surface is movable in supporting abutment on the second surface by means of the opening aid actuator. Further, the opening element is movable along a repelling direction in relation to the door and in particular in relation to the housing, wherein the repelling direction for example extends obliquely or perpendicularly to the opening direction. If the opening aid actuator moves the tappet and thus the first surface into a first direction coinciding with the opening direction, thus, the first surface first comes into supporting abutment on the second surface. If the opening aid actuator then moves the tappet and thus the first surface further into the first direction, thus, the surfaces slide on each other, whereby a movement of the opening element into a second direction coinciding with the repelling direction and thus extending obliquely or perpendicularly to the first direction is effected. Hereby, the opening element comes into supporting abutment on the housing, whereupon the door is repelled from the housing via the opening element and thereby moved into the open position. Advantages and advantageous configurations of the first aspect, the second aspect, the third aspect and the fourth aspect of the invention are to be regarded as advantages and advantageous configurations of the fifth aspect of the invention and vice versa.

In a sixth aspect of the invention, the opening aid includes an opening aid actuator provided in addition to the drive motor and a tappet. Further, the opening aid for example includes a link track also referred to as control link, with which the tappet for example engages. For example, the tappet is connected to the opening element in articulated manner. If the tappet is moved by means of the opening aid actuator, thus, the tappet is moved along the control cam such that the tappet and the opening element describe a movement trajectory corresponding to the control cam or move along the movement trajectory. Therein, the opening element first comes into supporting abutment on the housing, whereupon the door is repelled from the housing via the opening element and in particular the tappet. For example, if the tappet is in supporting abutment on the housing, thus, the opening aid actuator is for example supported on the housing, in particular via the tappet and via the opening element, on the one hand and for example at least indirectly supported on the door on the other hand, such that the door is for example supported on the housing or repelled from it via the opening aid actuator, the tappet and the opening element. Advantages and advantageous configurations of the first aspect, the second aspect, the third aspect, the fourth aspect and the fifth aspect are to be regarded as advantages and advantageous configurations of the sixth aspect of the invention and vice versa.

In a seventh aspect of the invention, the opening aid includes an in particular electrical or electrically operable opening aid actuator provided in addition to the drive motor, wherein the opening element is formed as a tappet at least translationally movable along a repelling direction by means of the opening aid actuator. By means of the opening aid actuator, the opening element or the tappet can for example be moved into a first direction coinciding with the repelling direction, whereby the door can for example be repelled from the housing via the tappet and the opening aid actuator and thereby is pivotable into the open position. Advantages and advantageous configurations of the first aspect, the second aspect, the third aspect, the fourth aspect, the fifth aspect and the sixth aspect of the invention are to be regarded as advantages and advantageous configurations of the seventh aspect of the invention and vice versa.

The aspects of the invention are to be regarded as aspects independent of each other, but which can be readily linked or combined with each other or used in any combination. In particular the advantages and features of the second aspect of the invention can also be transferred to the fifth, the sixth and the seventh aspect of the invention and vice versa such that the preamble of claim 10 can for example be readily regarded as the preamble for the fifth, the sixth and/or the seventh aspect.

Further advantages, features and details of the invention are apparent from the following description of preferred embodiments as well as based on the drawing. The features and feature combinations mentioned above in the description as well as the features and feature combinations mentioned below in the description of figures and/or shown in the figures alone are usable not only in the respectively specified combination, but also in other combinations or alone without departing from the scope of the invention.

BRIEF DESCRIPTION OF THE DRAWINGS

The drawings show in.

In the Figs., identical or functionally identical elements are provided with the same reference characters.

DESCRIPTION OF THE PREFERRED EMBODIMENTS

Figure 1:
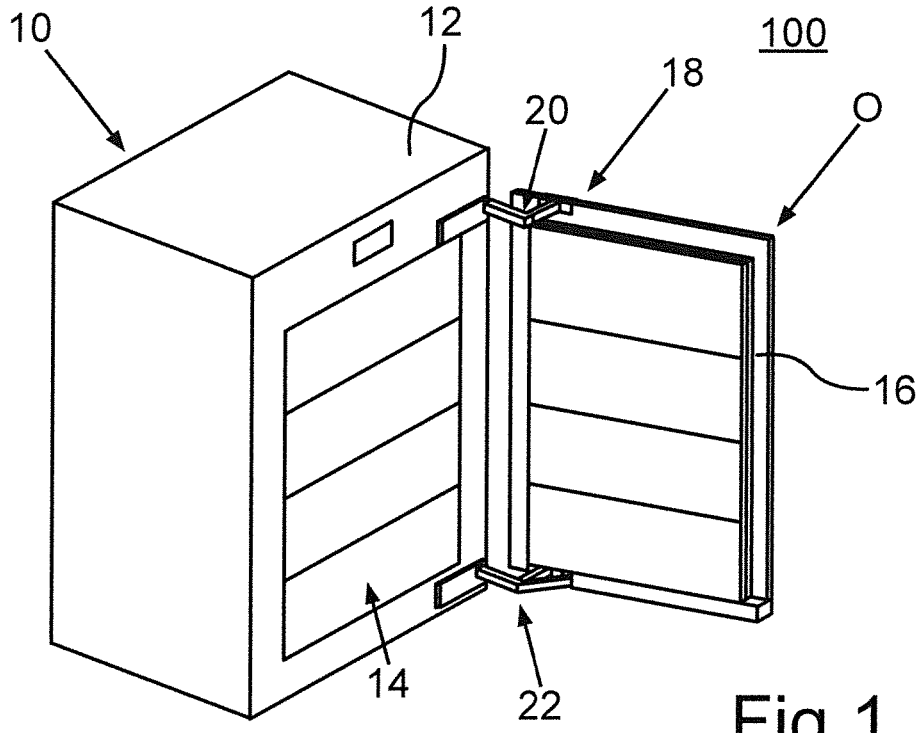
FIG. 1 a schematic perspective view of an appliance in particular formed as a cooling and/or refrigerating appliance with at least one arrangement according to the invention.

FIG. 1 shows an appliance 10 in a schematic perspective view, which is in particular formed as an electrical or electronic appliance. In particular, the appliance 10 is formed as a cooling and/or refrigerating appliance, which is also referred to as refrigerator and/or freezer. The appliance 10 includes a housing 12, by which at least one cavity 14 is formed. The cavity 14 is also referred to as trough, space or receiving space and is a cooling and/or refrigerating space in the embodiment illustrated in FIG. 1, in which objects and/or food can be arranged and cooled and/or frozen.

The appliance 10 also includes a door 16, which is a constituent of an arrangement overall denoted by 18. As is apparent from FIG. 1, the door 16 is retained on the housing 12 in articulated and thus pivotable manner, in particular via hinges 20 and 22, such that the door 16 can be pivoted in relation to the housing 12. The door 16 is for example pivotable in relation to the housing 12 between a closed position and an open position O shown in FIG. 1, wherein the open position O and the closed position are for example respective final positions or final postures such that the door 16 can be pivoted in relation to the housing 12 into the final postures, but not beyond the final postures, in its state pivotably retained on the housing 12. In particular, the door 16 can be pivoted into respective intermediate positions located between the open position O and the closed position, wherein the respective intermediate position is for example a respective further or second open position. In the intermediate position, the door 16 is further closed with respect to the open position O, but further opened with respect to the closed position. In the open position O or in the respective closed position, the door 16 uncovers at least a partial area of the cavity 14. In the closed position, the door 16 at least predominantly, in particular completely, covers and closes the partial area or the cavity 14.

As will be explained in more detail in the following, at least the hinge 22 is for example a constituent of the arrangement 18. In the arrangement 18—as is particularly well recognizable from FIG. 2—a drive device 24 is retained on the door 16 such that the drive device 24 is pivotable with the door 16 in relation to the housing 12. Therein, the drive device 24 is formed for pivoting the door 16 in relation to the housing 12. In other words, the door 16 can be pivoted in relation to the housing 12 by means of the drive device 24, in particular by motor and therein preferably by electric motor. In particular, the door 16 can be moved or pivoted from the closed position into the open position O and/or from the open position O into the closed position in relation to the housing 12 by means of the drive device 24, wherein the door 16 comes into the respective intermediate positions on its way from the closed position into the open position O and from the open position O into the closed position, respectively. Thus, the door 16 can also be moved and therein pivoted into the respective intermediate position in relation to the housing 12 by means of the drive device 24.

Figure 2:
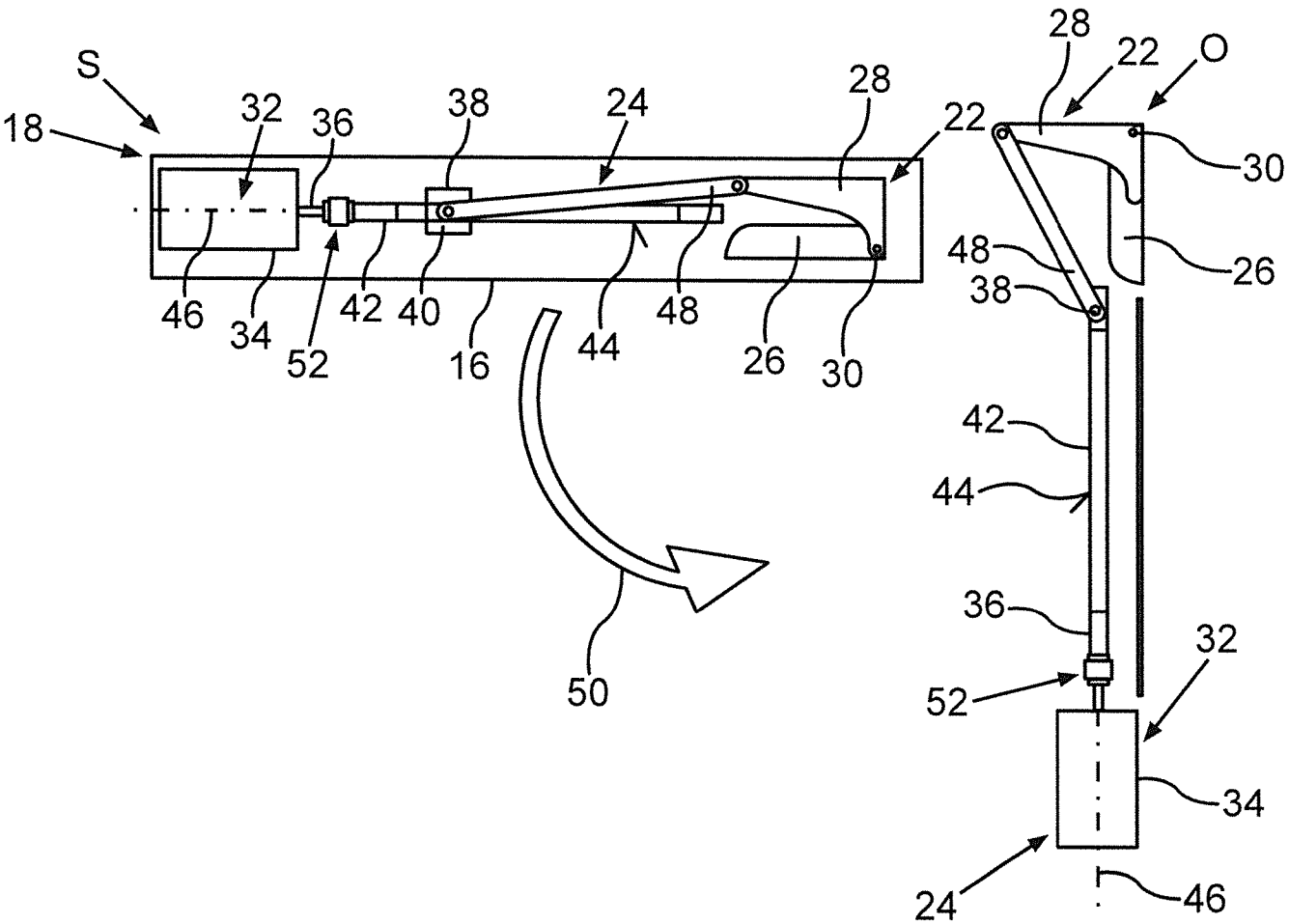
FIG. 2 a schematic top view of the arrangement according to the invention according to a first embodiment.

FIG. 2 shows a first embodiment of the arrangement 18, wherein the hinge 22 is formed as a single-joint hinge in the first embodiment. It is apparent from FIG. 2, that the drive device 24 includes at least the hinge 22. The hinge 22 comprises at least one first hinge part 26 attached to the door 16 and a second hinge part 28, which is attachable or attached to the housing 12. Therein, the hinge parts 26 and 28 are connected to each other in articulated manner. Since the hinge 22 is formed as a single-joint hinge in the first embodiment, exactly one joint 30 of the hinge 22 is provided. In other words, the hinge 22 includes exactly one joint 30, by means of which or via which the hinge parts 26 and 28 are connected to each other in articulated manner. The joint 30 forms a pivot axis, around which the hinge parts 26 and 28 are pivotable in relation to each other. Therein, the hinge parts 26 and 28 are pivoted in relation to each other around the pivot axis when the door 16 is opened or closed, that is pivoted in relation to the housing 12.

The drive device 24 further includes a drive motor 32, which is for example formed as an electric motor. Thus, the drive motor 32 for example includes a stator and a rotor, which is rotatable around a rotational axis in relation to the stator. Therein, the rotor is drivable by the stator and thereby rotatable around the rotational axis in relation to the stator. The drive motor 32 can provide at least one torque via the rotor, by means of which the door 16 can be pivoted in relation to the housing 12. The stator and the rotor are for example received in a housing 34 of the drive motor 32, wherein the rotor is rotatable around the rotational axis in relation to the housing 34. In particular, the rotor includes a shaft 36, which is also referred to as driven shaft of the drive motor 32. The drive motor 32 can provide the previously mentioned torque for pivoting the door 16 via the driven shaft.

The drive device 24 further includes at least one transmission element at least indirectly coupled to the hinge 22, in particular to the housing-side hinge part 28, in articulated manner, which is formed as a threaded nut 38. The transmission element (threaded nut 38) is drivable for pivoting the hinge parts 26 and 28 in relation to each other and thus for pivoting the door 16 in relation to the housing 12 by means of the drive motor 32, in particular by means of the torque provided by the drive motor 32, and thereby rectilinearly or linearly movable in relation to the door 16 to thereby pivot the door 16 in relation to the housing 12. Therein, the threaded nut 38 comprises a first thread in the form of an internal thread 40. Furthermore, the drive device 24 includes a threaded spindle 42 corresponding to the threaded nut 38, which comprises a second thread in the form of an external thread 44 corresponding to the internal thread 40. The threaded spindle 42 is drivable by means of the drive motor 32 and thereby rotatable around the rotational axis denoted by 46 in FIG. 2 in relation to the door 16 and in relation to the threaded nut 38, whereby the threaded nut 38 is movable rectilinearly along the threaded spindle 42 and in relation to it with form-fit cooperation of the threads. In other words, the threaded spindle 42 is rotated around the rotational axis 46 in relation to the door 16 by means of the drive motor 32, while the threaded nut 38 is for example at least indirectly, in particular directly, supported on the door 16 against a rotation in relation to the door 16 resulting from the rotation of the threaded spindle 42 and is thereby secured, and while the threads engage with each other and thus cooperate in form-fit manner, thus the threads convert the relative rotation between the threaded spindle 42 and the threaded nut 38 into a translational relative movement between the threaded nut 38 and the threaded spindle 42 such that the threaded nut 38 rectilinearly or linearly moves along the threaded spindle 42 and therein in relation to it within the scope of the translational relative movement. Since the threaded nut 38 is therein coupled to the hinge part 28 in articulated manner, a relative movement between the hinge parts 26 and 28 around the mentioned pivot axis is effected by the movement of the threaded nut 38 along the threaded spindle 42, whereby the door 16 is pivoted in relation to the housing 12. The articulated coupling of the threaded nut 38 to the hinge part 28 is realized by at least one connecting lever 48 in the first embodiment, which is coupled to the hinge part 28 in articulated manner on the one hand, in particular at one end, and coupled to the threaded nut 38 in articulated manner on the other hand, in particular at the other end.

In FIG. 2, an arrow 50 illustrates a pivot movement referred to as door opening movement, within the scope of which the door 16 is moved from the closed position into the open position O by means of the drive motor 32 in the described manner. Therein, the closed position is denoted by S in FIG. 2. It is apparent from FIG. 2 that the drive device 24 moreover comprises a coupling device 52, the construction and function of which are explained in more detail in the following. Therein, the threaded spindle 42 is drivable by the shaft 36 and thus by the drive motor 32 via the coupling device 52 such that the door 16 can be driven by the drive motor 32, in particular by the shaft 36, via the threaded nut 38, the threaded spindle 42 and the coupling device 52 and thus can be pivoted in relation to the housing 12.

Figure 3:
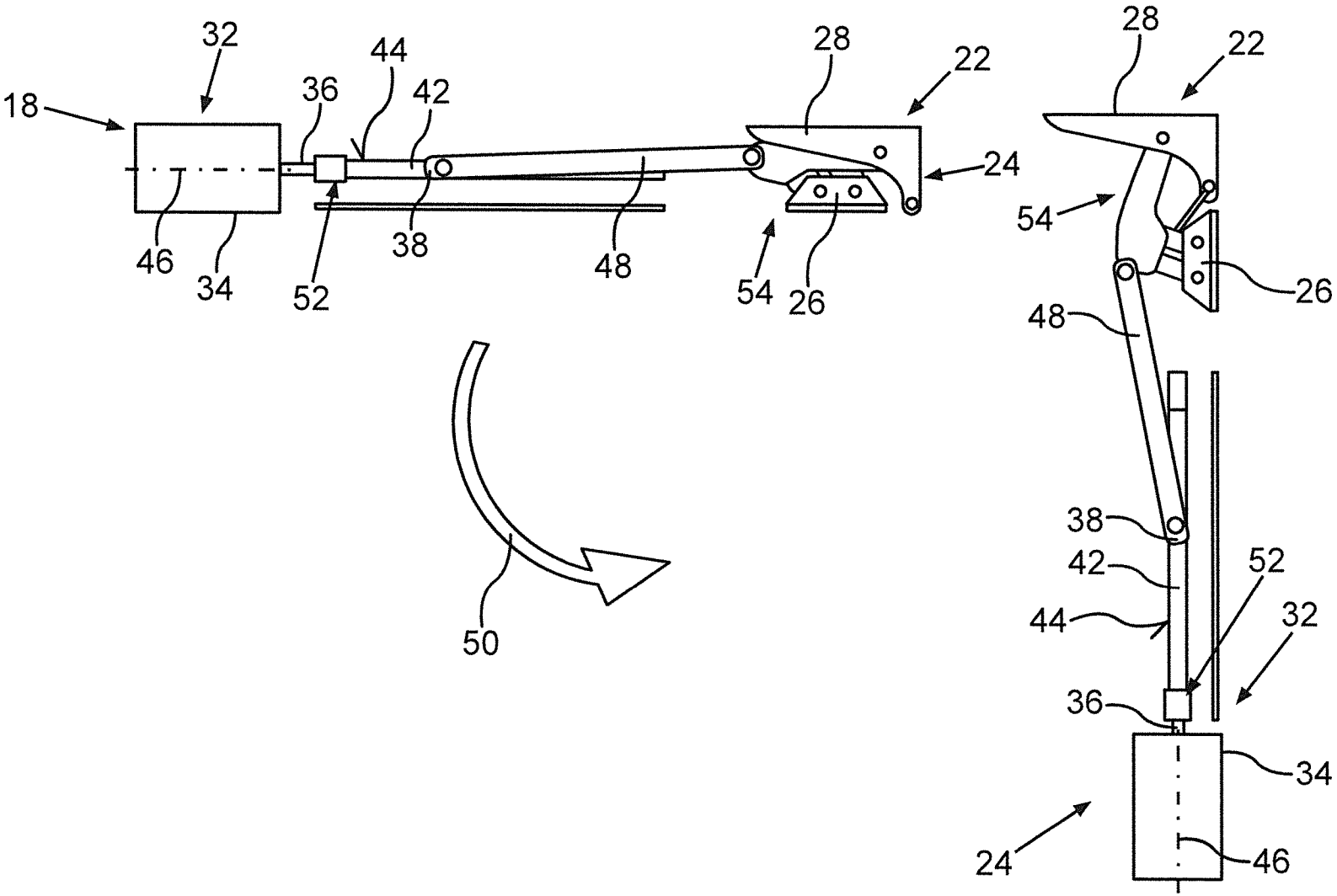
FIG. 3 a schematic top view of the arrangement according to a second embodiment.

FIG. 3 shows a second embodiment of the arrangement 18, wherein the door 16 is not illustrated for the sake of clarity in FIG. 2. The second embodiment in particular differs from the first embodiment in that the hinge 22 is not just formed as a single-joint hinge, but as a multi-joint hinge. Therein, the hinge parts 26 and 28 are connected to each other in articulated manner via at least one or multiple intermediate hinge parts 54. The intermediate hinge parts 54 are in turn coupled both to the hinge part 26 in articulated manner and to the hinge part 28 in articulated manner such that the hinge part 26 is connected to the hinge part 28 in articulated manner via the intermediate hinge parts 54. The use of the single-joint hinge is for example suitable in floor-mounted appliances, which are not installed in pieces of furniture such as for example kitchen furniture, but stand separately and alone. By the employment of the single-joint hinge, the number of parts and thus the cost can be kept particularly low. The use of the multi-joint hinge is particularly advantageously suitable for built-in appliances, which can for example be installed in pieces of furniture like kitchen furniture, such that the door 16 can for example be flush in surface with doors and/or drawers adjoining to the door 16 and still be opened without collision.

Figure 4:
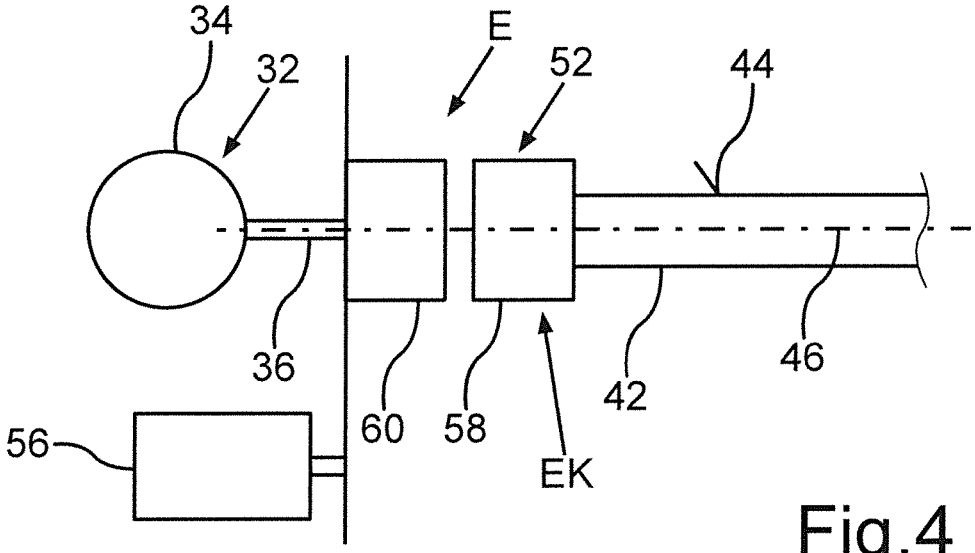
FIG. 4 partially a schematic top view of the arrangement according to a third embodiment.
Figure 5:
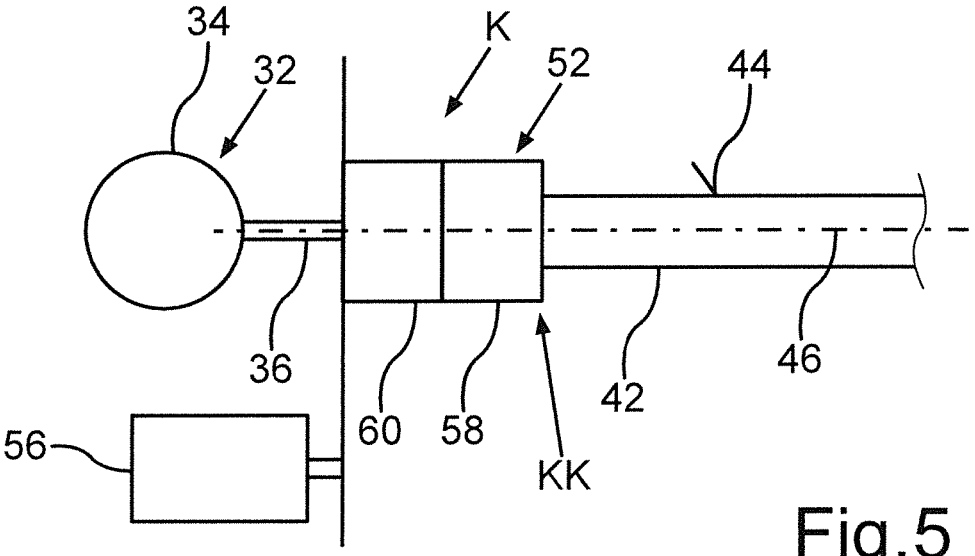
FIG. 5 partially a further schematic top view of the arrangement according to the third embodiment.

FIGS. 4 and 5 show a third embodiment of the arrangement 18. As is apparent from FIGS. 4 and 5, the coupling device 52 is switchable between at least one coupling state shown in FIG. 5 and denoted by K and at least one uncoupling state shown in FIG. 4 and denoted by E. In the coupling state, the threaded nut 38 is coupled to the drive motor 32 such that a force or torque transmission path between the door 16 and the drive motor 32 is for example closed. The force or torque transmission path is also referred to as transmission path, via which forces or torques can be transmitted between the door 16 and the drive motor 32. If the transmission path is closed, thus, forces or torques can be transmitted between the door 16 and the drive motor 32 via the transmission path. In the uncoupling state E, the threaded nut 38 is uncoupled from the drive motor 32 such that the transmission path is interrupted. Hereby, forces or torques cannot be transmitted between the door 16 and the drive motor 32 in the uncoupling state E. Thus, it is for example possible in the coupling state K to pivot the door 16 in relation to the housing 12 by means of the drive motor 32 such that the door 16 can be particularly simply and comfortably opened and/or closed. In the uncoupling state E, the door 16 can for example be manually moved in relation to the housing 12 by a person without such a manual movement of the door 16 being impaired or impeded by the drive motor 32. Thus, the person can simply and thus comfortably open and close, respectively, the door 16.

In the third embodiment, the coupling device 52 includes at least one coupling actuator 56 provided in addition to the drive motor 32, which is for example formed as an electrical actuator or in electrically drivable manner. In addition, the coupling device 52 includes a first coupling element 58 and a second coupling element 60 corresponding thereto. In the third embodiment, the coupling element 58 is for example rotationally fixedly connected to the threaded spindle 42. Further, the coupling element 60 is for example rotationally fixedly connected to the rotor or to the shaft 36 of the drive motor 32. By means of the coupling actuator 56, at least one of the coupling elements 58 and 60 is for example movable in relation to the door 16 as well as for example in relation to the respectively other one of the coupling elements 58 and 60, whereby the at least one coupling element 58 or 60 is for example, in particular translationally and/or rotationally, movable between an uncoupling position EK effecting the uncoupling state E and shown in FIG. 4 and a coupling position KK effecting the coupling state K and shown in FIG. 5 in relation to the door 16 and optionally in relation to the respectively other coupling element 60 or 58.

In the coupling state K or in the coupling position KK, the coupling elements 58 and 60 for example cooperate in form-fit manner such that the threaded spindle 42 or the threaded nut 48 is at least form-fit coupled to the drive motor 32 via the coupling device 52 in the coupling state K. Thereby, the torque provided by the drive motor 32 can be efficiently and effectively transmitted from the drive motor 32 via the coupling device 52 to the threaded spindle 42 and further to the threaded nut 38. In the uncoupling state E or in the uncoupling position EK, the coupling elements 58 and 60 are for example spaced from each other such that they do not cooperate, in particular not cooperate in form-fit manner. Thereby, the threaded spindle 42 or the threaded nut 38 is uncoupled from the drive motor 32.

In the third embodiment shown in FIGS. 4 and 5, the coupling elements 58 and 60 are components different from the threaded nut 38, provided in addition to the threaded nut 38. In particular, the at least one coupling element 58 or 60 is, at least translationally, movable in axial direction of the threaded spindle 42 and along the rotational axis 46, respectively, in relation to the threaded spindle 42 and/or in relation to the shaft 36 or the rotor by means of the coupling actuator 56. The coupling device 52 is also referred to as coupling, which is opened in the uncoupling state E and closed in the coupling state K. In order to close the coupling, the coupling elements 58 and 60 are for example compressed by means of the coupling actuator 56, whereby the coupling elements 58 and 60 cooperate in form-fit manner.

The threaded spindle 42 and the corresponding threaded nut 38 form a threaded spindle drive, which does not have self-retention, that is it is free of self-retention, at least in a state, in which the threaded nut 38 is arranged on the threaded spindle 42 such that the threads engage with each other. Hereby, it is basically possible that the threaded nut 38 can be rectilinearly moved along the threaded spindle 42 via the connecting lever 48 and the hinge 22 from the door 16 for example if a person manually pivots the door 16, wherefrom a rotation of the threaded spindle 42 around the rotational axis 46 results. However, the drive motor 32 for example has self-retention such that the previously described, manually effected rotation of the threaded spindle 42 by the drive motor 32, in particular by the self-retention thereof, would for example be prevented. Thus, a person could for example not manually pivot the door 16 or only with very high force input if the drive motor 32 is coupled to the door 16. However, if the coupling is now opened, thus, the door 16 is uncoupled from the drive motor 32 such that the door 16 can be manually moved in the described manner, because the drive motor 32 is not opposed to the described rotation of the threaded spindle 42 with opened coupling.

Figure 6:
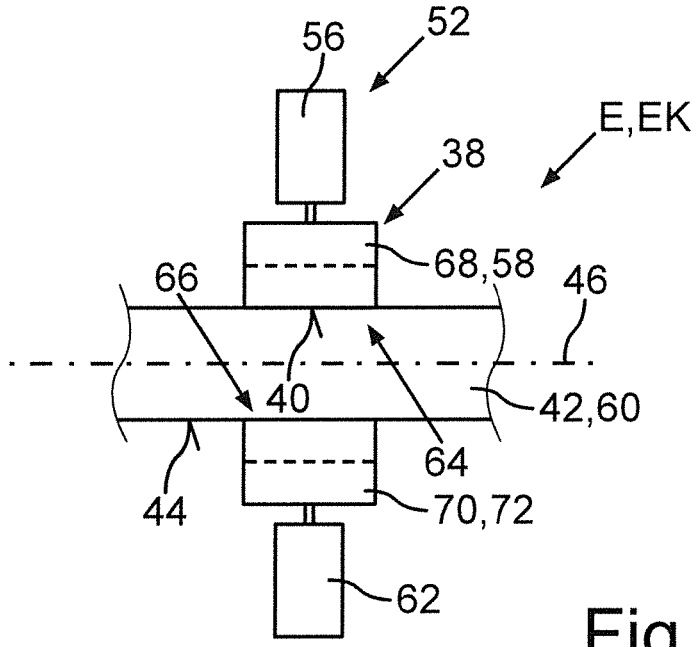
FIG. 6 partially a schematic top view of the arrangement according to a fourth embodiment.
Figure 7:
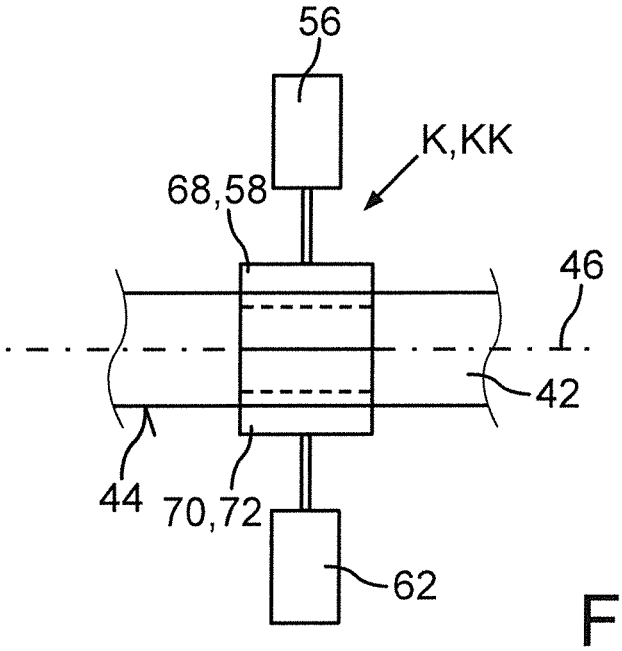
FIG. 7 partially a further schematic top view of the arrangement according to the fourth embodiment.

FIGS. 6 and 7 show a fourth embodiment of the arrangement 18. The fourth embodiment in particular differs from the third embodiment with respect to its construction of the coupling device 52. In the fourth embodiment, the coupling device 52 includes the coupling actuator 56 as well as for example a second coupling actuator 62 provided in addition to the coupling actuator 56 and in addition to the drive motor 32. In addition, it is provided in the fourth embodiment that the threaded nut 38 comprises at least two nut elements 68 and 70 forming at least respective parts 64 and 66 of the internal thread 40, which are movable in relation to each other and in particular in relation to the threaded spindle 42, in particular in radial direction of the threaded spindle 42. Herein, the nut element 68 is for example movable in relation to the threaded spindle 42 and in relation to the door 16, in particular in radial direction of the threaded spindle 42, by means of the coupling actuator 56. Further, the nut element 70 is for example movable in relation to the door 16 and in relation to the threaded spindle 42, in particular in radial direction of the threaded spindle 42, by means of the coupling actuator 62. Therein, the previous and following explanations to the coupling actuator 56 can be readily transferred to the coupling actuator 62 and vice versa.

Now, in order to keep the number of parts particularly low, the nut element 68 is for example formed as the coupling element 58, wherein the threaded spindle 42 is formed as the coupling element 60. Furthermore, the nut element 70 is a third coupling element, wherein the following and previous explanations to the first coupling element 58 can for example also readily be transferred to the third coupling element 72 and vice versa. The nut elements 68 and 70 or the coupling elements 58 and 72 are movable by means of the coupling actuators 56 and 62 between a respective uncoupling position E illustrated in FIG. 6 and effecting the uncoupling state EK and a respective coupling position KK shown in FIG. 7 and effecting the coupling state K in relation to the threaded spindle 62 or in relation to the coupling element 60 and for example in relation to each other. Therein, the connecting lever 48 is for example connected to at least one of the nut elements 68 and 70 in articulated manner such that the hinge 22 or the hinge part 28 is for example connected at least to one of the nut elements 68 and 70 in articulated manner.

In the respective coupling position KK, the nut elements 68 and 70 cooperate with the threaded spindle 42 in form-fit manner via the respective parts 64 and 66 and the external thread 44 of the threaded spindle 42 since the parts 64 and 66 or the internal thread 40 engage or engages with the corresponding external thread 44. If the threaded spindle 42 is then rotated around the rotational axis 46 in relation to the threaded nut 38 in the described manner, thus, the door 16 is thereby pivoted in relation to the housing 12. However, in the respective uncoupling position EK, the parts 64 and 66 are out of engagement with the internal thread 44 such that the nut elements 68 and 70 do not cooperate with the threaded spindle 42. As a result, the threaded nut 38 can be manually moved along the threaded spindle 42 and in relation to it via the door 16 in the described manner without a rotation of the threaded spindle 42 around the rotational axis 46 occurring and thus without the drive motor 32 impairing or influencing the manual pivoting of the door 16. In the fourth embodiment, the threaded spindle 42 is for example still coupled, in particular rotationally fixedly connected, to the drive motor 32 or to the shaft 36 in the uncoupling state E, but the threaded nut 38 is uncoupled from the threaded spindle 42 and thus from the drive motor such that the door 16 is uncoupled from the drive motor 32. Thus, a person can simply and comfortably open and close the door 16, respectively. Overall, it is apparent from FIGS. 6 and 7 that the two- or multi-part formed threaded nut 38 is opened in the uncoupling state E and closed in the coupling state K.

Figure 8:
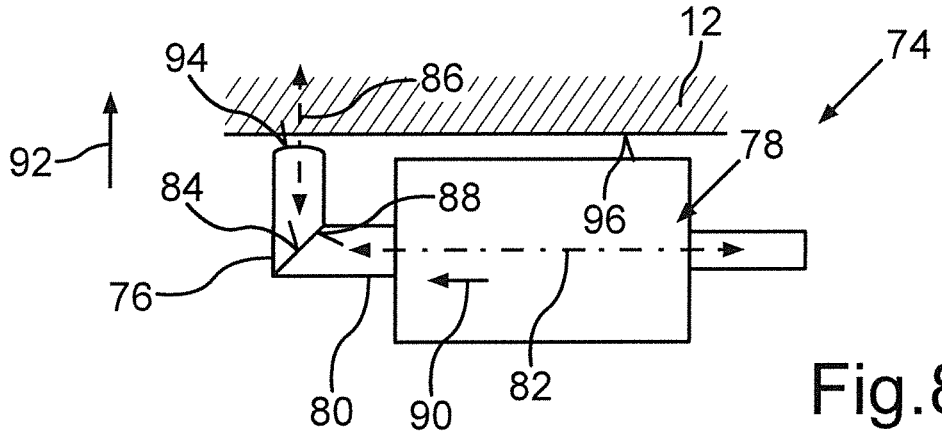
FIG. 8 partially a schematic top view of the arrangement according to a fifth embodiment.
Figure 9:
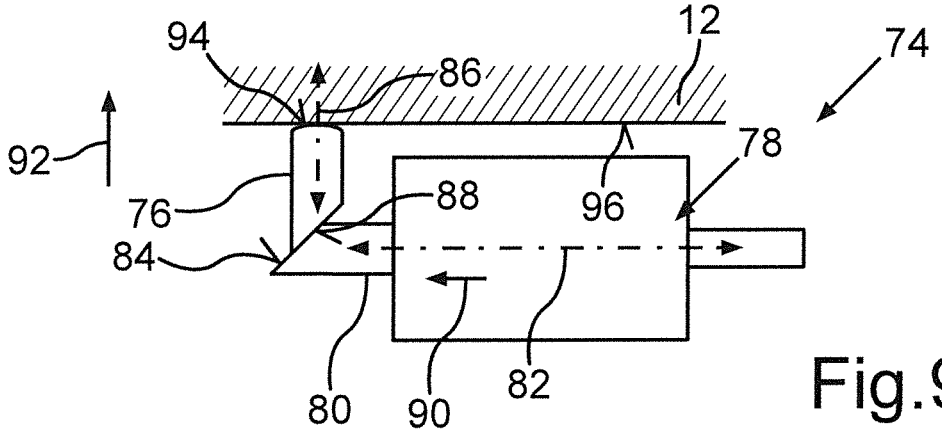
FIG. 9 partially a further schematic top view of the arrangement according to the fifth embodiment.

FIGS. 8 and 9 show a fifth embodiment. Therein, the drive device 24 comprises an opening aid 74, which includes at least one opening element 76. As will be explained in more detail in the following, the opening element 76 is movable in relation to the door 16 and in relation to the housing 12 into supporting abutment on the housing 12, wherein the opening element 76 is translationally movable in relation to the door 16 and in relation to the housing 12 into supporting abutment on the housing 12 in the fifth embodiment. Therein, the opening element 76 is movable into supporting abutment on the housing 12 to thereby repel the door 16 from the housing 12 and thereby pivot it from the closed position S into one of the intermediate positions, that is into one of the further open positions. Hereby, the door 16 can be initially opened. Starting from the intermediate position, into which the door 16 can be pivoted by means of the opening aid 74, the door can be further opened with an only low torque by means of the drive motor 32.

In the fifth embodiment, the opening aid 74 comprises an opening aid actuator 78 provided in addition to the drive motor 32, which is for example also provided in addition to the coupling actuator 56 and/or 62. The opening aid actuator 78 can for example be or is supported on the door 16 on the one hand, and the opening aid actuator 78 is or can be supported on the opening element 76, in particular via a tappet 80 of the opening aid 74, on the other hand. In the fifth embodiment, the tappet 80 is, in particular translationally, movable along an opening direction 82 for example extending parallel to the rotational axis 46 by means of the opening aid actuator 78, in particular in relation to the housing 12 and/or in relation to the door 16. Therein, the tappet 80 comprises a first surface 84, which extends obliquely to the opening direction 82. The opening element 76 is, in particular translationally, movable along a repelling direction 86 extending obliquely or presently perpendicularly to the opening direction, in relation to the housing 12 and/or in relation to the door 16. Therein, the opening element 76 comprises a second surface 88 corresponding to the first surface 84, which extends obliquely to the repelling direction 86 and obliquely to the opening direction 82. Further, the surface 84 extends obliquely to the repelling direction 86.

For example, if the tappet 80 is moved into a first direction 90 coinciding with the opening direction by means of the opening aid actuator 78, thus, the surfaces 84 and 88 first come into supporting abutment on each other, and as a result the surfaces 84 and 88 also referred to as inclined planes slide on each other. Thereby, the opening element 76 is moved into a second direction 92 coinciding with the repelling direction 86, which accordingly extends obliquely or perpendicularly to the first direction. By moving the opening element 76 into the second direction, the opening element 76 first comes into supporting abutment on the housing 12, in particular with a front side 94 of the opening element 76. If the opening element 76 is further moved into the second direction by for example moving the tappet 80 further into the first direction, thus in that the opening aid actuator 78 supports itself at least indirectly, in particular directly, on the door 16 on the one hand and on the housing 12 via the tappet 80 and the opening element 76 on the other hand, it is repelled from the housing 12 and thus pivoted from the closed position into one of the intermediate positions and thus initially opened. This is particularly well apparent from FIG. 9, in which the surfaces 84 and 88 already have integrally slid on each other. Therein, the opening aid actuator 78, the tappet 80 and the opening element 76 are at least indirectly retained on the door 16 and pivotable with the door 16. For example, the opening element 76 lifts off from the housing 12, in particular from a corresponding repelling surface 96 of the housing 12, after initially opening the door 16. Overall, it is apparent from FIGS. 8 and 9 that the surfaces 84 and 88 form a wedge system, which is actuated by means of the opening aid actuator 78 to initially open the door 16.

Figure 10:
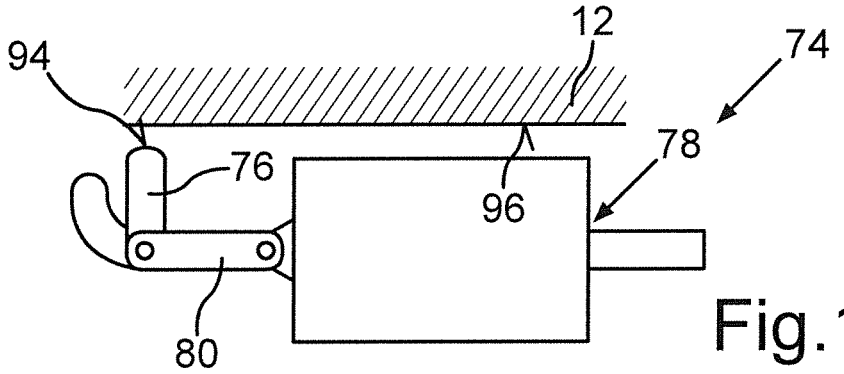
FIG. 10 partially a schematic top view of the arrangement according to a sixth embodiment.
Figure 11:
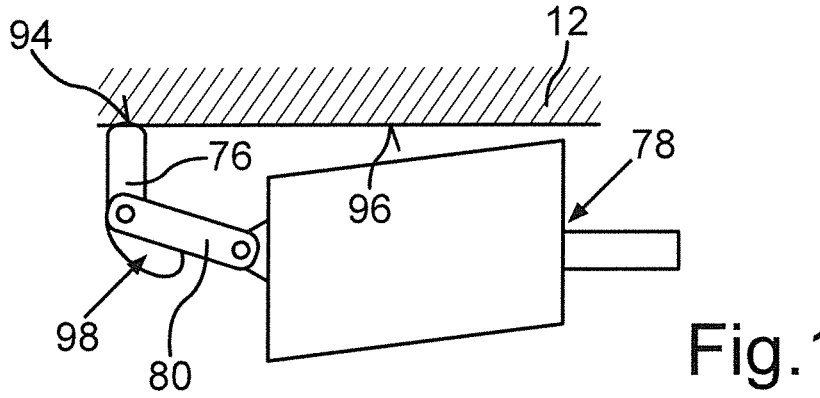
FIG. 11 partially a further schematic top view of the arrangement according to the sixth embodiment.

FIGS. 10 and 11 show a sixth embodiment, which differs from the fifth embodiment in particular with respect to the opening aid 74. In the sixth embodiment, the tappet 80 is for example connected to the opening aid actuator 78 in articulated manner on the one hand and to the opening element 76 in articulated manner on the other hand. In addition, a guide link 98 also referred to as control cam is provided, which is also referred to as link track or guide track and at least substantially extends in arcuate manner. Therein, the opening element 76 and/or the tappet 80 engage with the link track 98 such that the tappet 80 and the opening element 76 are guided by means of and along the link track 98 if the tappet 80 and the opening element 76 via it are moved in relation to the door 16 by means of the opening aid actuator 78. Since the tappet 80 is coupled to the opening aid actuator 78 in articulated manner on the one hand and to the opening element 76 in articulated manner on the other hand, the opening element 76 is connected to the opening aid actuator 78 via the tappet 80 in articulated manner. Further, the opening aid actuator 78 is for example coupled to the door 16 in articulated manner and thus supported on it in articulated manner. If the tappet 80 and the opening element 76 via it are moved along the link track 98 by means of the opening aid actuator 78, thus, the opening element 76, in particular via the front side 94 thereof, first comes into supporting abutment on the housing 12, in particular on the surface 96 thereof. Thereupon, the door 16 is repelled from the housing 12 via the opening aid actuator 78, the tappet 80 and the opening element 76 and thus initially opened. By the use of the link track 98, a particularly advantageous force or torque transmission from the opening aid actuator 78 to the housing 12 and thus between the door 16 and the housing 12 can be realized such that the door 16 can be particularly advantageously, in particular fast, opened even if a high negative pressure exists in the cavity 14 with respect to an environment 100 (FIG. 1) of the appliance 10.

Figure 12:
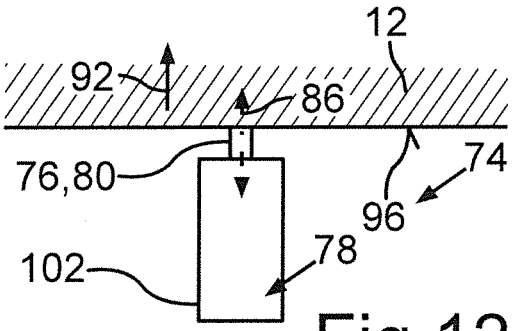
FIG. 12 partially a schematic top view of the arrangement according to a seventh embodiment.
Figure 13:
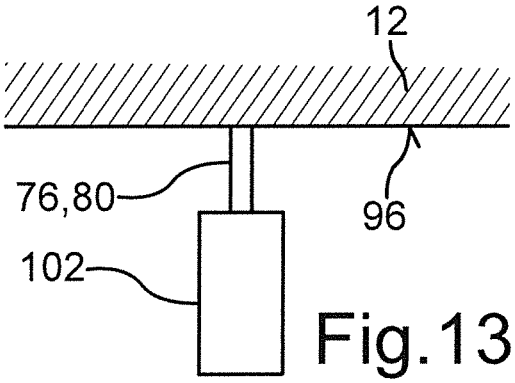
FIG. 13 partially a further schematic top view of the arrangement according to the seventh embodiment.

FIGS. 12 and 13 show a seventh embodiment of the arrangement 18, wherein the seventh embodiment differs from the fifth and the sixth embodiment in particular in the configuration of the opening aid 74. In the seventh embodiment, the opening element 76 functions as the tappet 80 described with respect to the fifth and the sixth embodiment, such that the opening element 76 is at least translationally movable along the repelling direction 86 by means of the opening aid actuator 78. Since the opening aid actuator 78 is at least indirectly, in particular directly, supported or supportable on the door 16 on the one hand and supportable or supported on the housing via the opening element 76 on the other hand, if the opening element 76 is moved along the repelling direction and therein into the second direction 92, the door 16 is repelled from the housing 12 via the opening aid 74 and thereby initially opened. Upon moving the opening element 76 into the direction 92, the opening element 76 is for example extended from the opening aid actuator 78, in particular from the housing 102 thereof. Thereafter, the opening element 76 can for example be again retracted into the housing 102. In the seventh embodiment, the opening aid actuator 78 and the opening element 76 for example form a lifting cylinder actuator, by means of which a simple, but efficient and effective opening aid can be represented.

Figure 14:
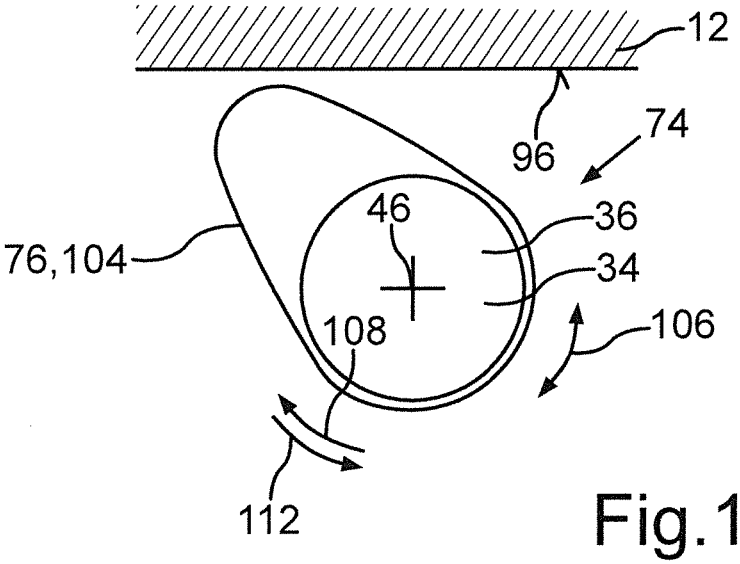
FIG. 14 partially a schematic front view of the arrangement according to an eighth embodiment.
Figure 15:
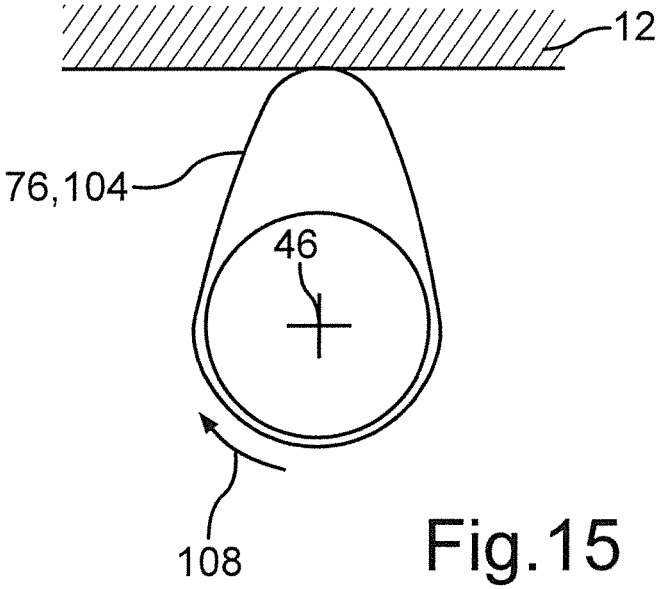
FIG. 15 partially a further schematic front view of the arrangement according to the eighth embodiment.

FIGS. 14 and 15 show an eighth embodiment, which differs from the fifth, the sixth and the seventh embodiment in particular with respect to the opening aid 74. In the eighth embodiment, the opening element 76 is formed as a cam 104 also referred to as opening cam. Therein, the opening element 76 or the cam 104 is rotationally fixedly connected to the drive motor 32, in particular to the housing 34 of the drive motor 32, wherein the housing 34 and the opening element 76 are rotatable around the rotational axis 46 in relation to the door 16, in particular within certain limits, which is illustrated by a double arrow 106 in FIG. 14.

FIG. 14 for example shows an initial state, in which the opening element 76 is spaced from the housing 12 and thus is not in supporting abutment on the housing 12. Further, the door 16 is for example closed in this initial state such that the door 16 is in the closed position S. In addition, the door 16 is for example coupled to the drive motor 32 in the initial state such that the coupling is for example closed, that is that the coupling device 52 is in the coupling state K.

For example, if the drive motor 32 then provides the previously mentioned torque for pivoting the door 12 via the rotor or the shaft 36, thus, this torque provided by the drive motor 32 via the shaft 36, which in particular acts around the rotational axis 46, is for example supported on the door 16 via the threaded spindle 42, the threaded nut 38 and the hinge 22 on the one hand and for example supported on the housing 12 via the door. However, the torque is not supported on the other hand since the opening element 76 and the housing 34 and thus the stator, from which for example the torque is exerted on the rotor, are rotatable in relation to the door 16 and the opening element 76 is not yet in supporting abutment on the housing 12, in particular on the surface 96, in the initial state. Thereby, first the housing 34 and thus the stator and the opening element 76 rotate around the rotational axis 46 in relation to the door 16 and in relation to the housing 12 into a first rotational direction illustrated by an arrow 108 in FIG. 14, in particular first until the opening element 76 comes into supporting abutment on the housing 12. Then, the torque provided by the drive motor 32 is supported on the housing 12 via the housing 34 and the opening element 76 on the other hand and in particular transmitted to the housing 12. If the torque is further provided by the drive motor 32, thus, the housing 34 and thus the stator rotate around the rotational axis 46 around the opening element 76 rotationally fixedly connected to the housing 34 further into the first rotational direction in relation to the housing 12 and in relation to the door 16, whereby the door 16 is repelled from the housing 12 via the drive motor 32 and the opening element 76 and thereby initially opened. For example, this is illustrated in FIG. 15.

Figure 19:
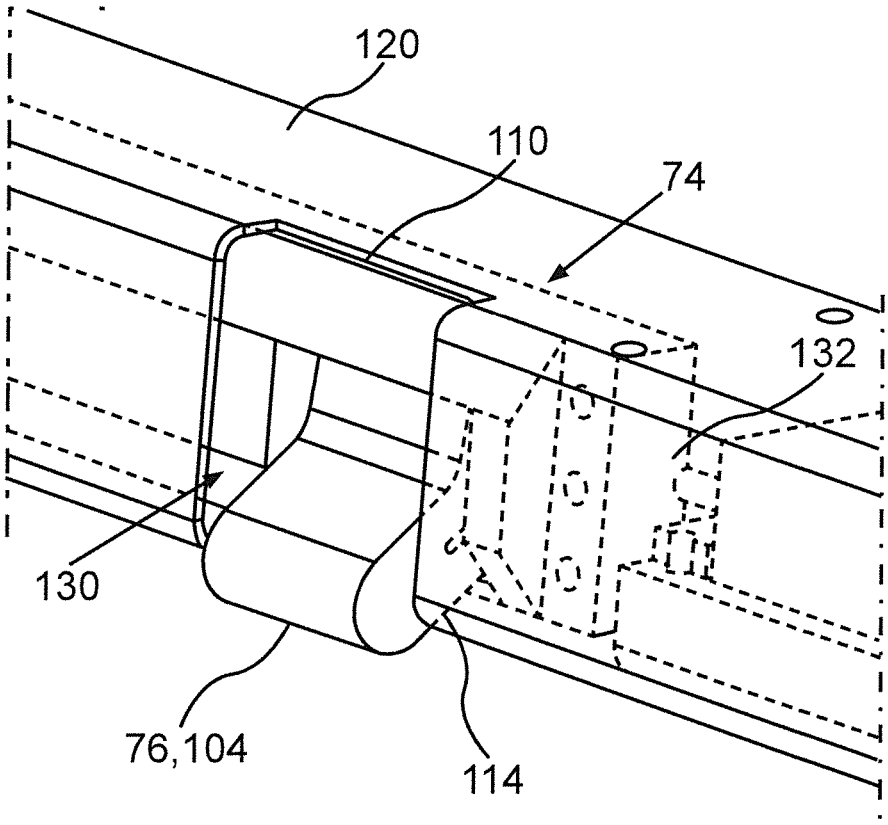
FIG. 19 partially a further schematic perspective view of the arrangement according to the ninth embodiment.

If the torque is further provided by the drive motor 32, thus, the housing 34 and thus the stator and the opening element 76 for example further rotate into the first rotational direction around the rotational axis 46 in relation to the door 16 and for example to the housing 12, in particular until the opening element 76 for example comes into supporting abutment on a stop 110 provided on the door 16 and apparent from FIG. 19. Then, the torque is supported on the stop 110 and thus at least indirectly on the door 16 via the housing 34 and the opening element 76 on the other hand. If the drive motor 32 further provides the torque, thus, the torque results in a rotation of the threaded spindle 42 around the rotational axis 46 in relation to the door 16 in that a further rotation of the stator via the housing 34 and the opening element 76 is prevented by means of the stop 110. As a result, the hinge parts 26 and 28 are pivoted in relation to each other by means of the drive motor 32 in the described manner, whereby the door 16 is pivoted, in particular opened, in relation to the housing 12. The torque for opening the door 16 thus for example acts into the first rotational direction illustrated by the arrow 108. In order to for example close the door 16, the drive motor 32 provides a torque, which acts around the rotational axis 46 into a second rotational direction opposite to the first rotational direction, which is for example illustrated by an arrow 112 in FIG. 14.

For example, if the opening element 76 formed as a cam 104 is in supporting abutment on the stop 110, thus, at least one spring element not apparent in the Fig. is tensioned, which thus provides a spring force, which at least indirectly acts on the opening element 76. The opening element 76 is for example retained in supporting abutment on the stop 110 against the spring force by means of the drive motor 32 or by means of the torque provided by the drive motor 32. If providing the torque is terminated, thus, the spring element for example can relax, whereby the opening element 76 and with it the housing 34 and the stator are for example rotated into the second rotational direction in relation to the door 16. In particular, the opening element 76 is rotated or retained in supporting abutment on a second stop 114 provided on the door, opposing the stop 110 by means of the spring force.

In order to close the door 16 by means of the drive motor 32, the drive motor 32 provides the torque also referred to as the second torque, acting into the second rotational direction. By means of the second torque, the opening element 76 and thus the housing 34 or the stator is for example rotated in relation to the door 16 into supporting abutment on the second stop 114 in particular if the opening element 76 is not yet in supporting abutment on the second stop 114. If the opening element 76 is in supporting abutment on the second stop 114, thus—as previously described with respect to the torque for opening the door 16—the second torque is supported on the door 16 via the opening element 76 on the other hand, such that the second torque effects a rotation of the threaded spindle 42 around the rotational axis 46 into the second rotational direction. As a result, the door 16 is pivoted in relation to the housing 12 and therein closed. Since the opening element 76 is in supporting abutment on the stop 114, the opening element 76 assumes an initial position as in the initial state shown in FIG. 14 such that the opening element 76 does not impair or prevent the movement of the door 16 into the closed position S.

FIGS. 16 to 19 show a ninth embodiment, which is or includes for example a combination of the eighth embodiment and the second embodiment. In the ninth embodiment, the hinge 22 is formed as the mentioned multi-joint hinge and the opening aid 74 is formed as in the eighth embodiment. In the ninth embodiment, an angle sensor 116 is provided, by means of which respective rotational positions of the threaded spindle 42 around the rotational axis 46 are or can be captured. Alternatively or additionally, a linear sensor 118 is provided, by means of which respective linear positions of the threaded nut 38 along the threaded spindle 42 are or can be captured.

Figure 16:
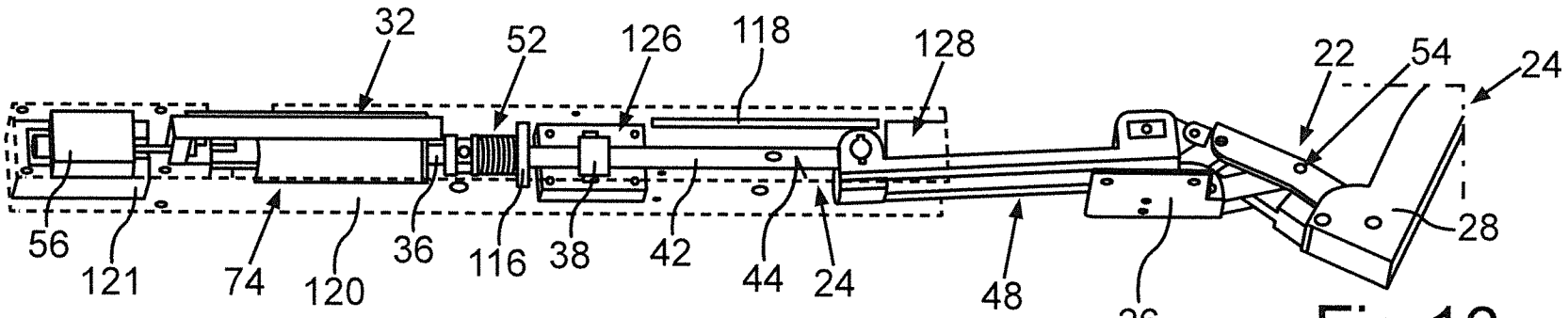
FIG. 16 partially a schematic perspective view of the arrangement according to a ninth embodiment.
Figure 17:
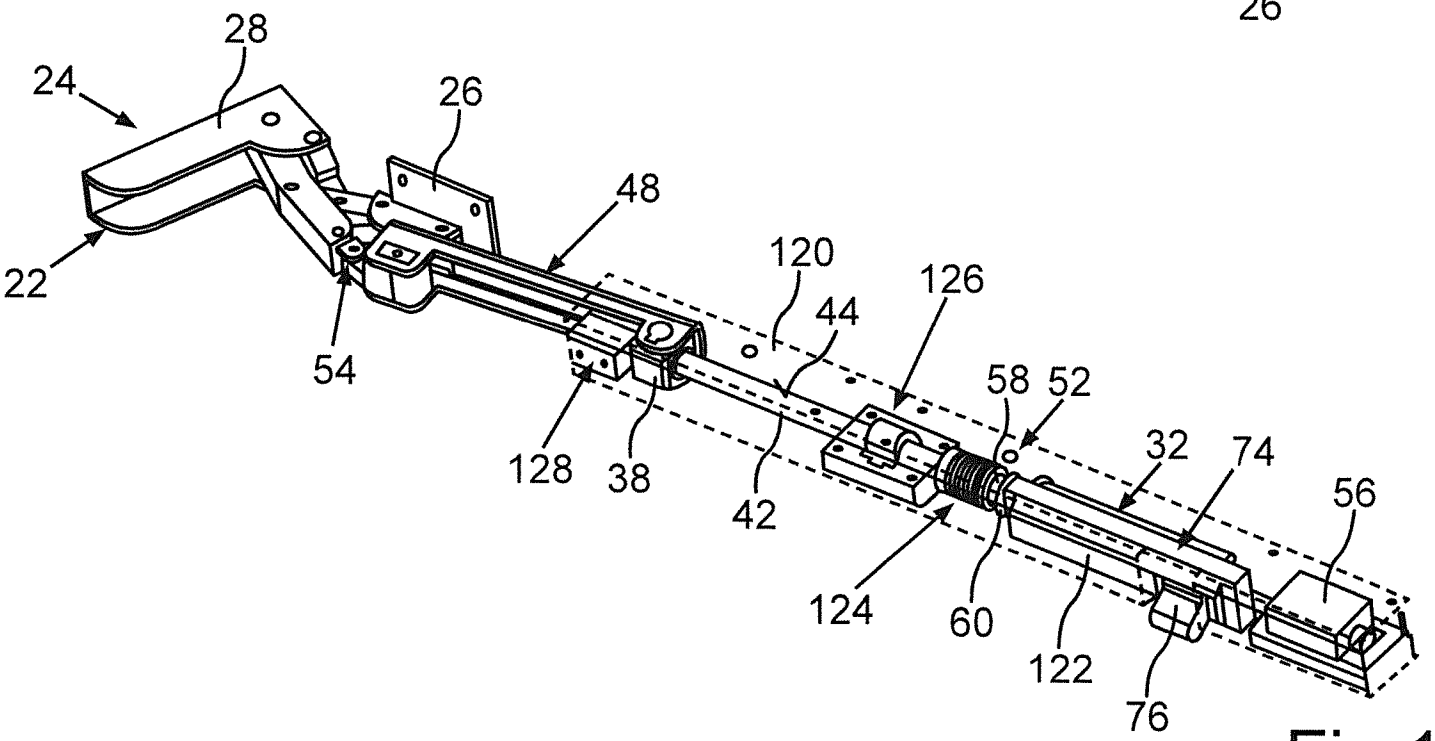
FIG. 17 partially a further schematic perspective view of the arrangement according to the ninth embodiment.
Figure 18:
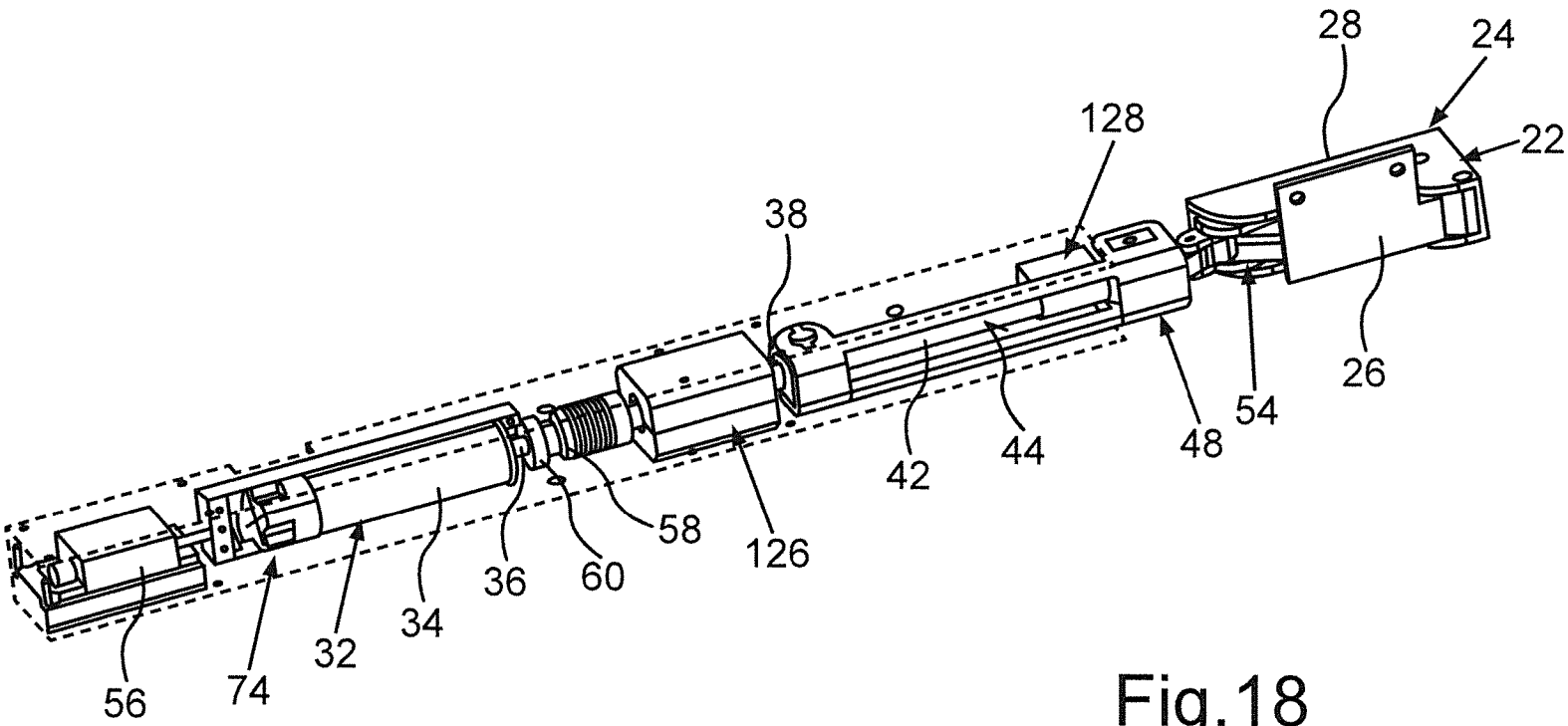
FIG. 18 partially a further schematic perspective view of the arrangement according to the ninth embodiment.

Furthermore, a housing 120 illustrated transparent in FIGS. 16 and 17 and for example formed of sheet metal is provided, in which the drive device 24 is for example arranged. In particular, the drive device 24 is attached to or supported on the door 16 via the housing 120, wherein the housing 120 is for example at least substantially U-shaped formed. In FIGS. 16 and 17, the coupling actuator 56 is moreover apparent, which is for example formed as a lifting magnet and is supported sliding in at least one or two opposing plastic bowls, of which one plastic bowl denoted by 121 is apparent in the Fig. The coupling actuator 56 is for example formed to translationally displace the drive motor 32 and the opening aid 74 in relation to the housing 120 and thus in relation to the door 16, on which the housing 120 is for example fixed, to thereby for example move the coupling element 60, connected to the rotor both in rotationally fixed manner and in a manner fixed in axial direction of the rotor, in axial direction of the threaded spindle 42 in relation to it and in relation to the coupling element 58 rotationally fixedly connected to the threaded spindle 42 and fixedly connected to the threaded spindle 42 in axial direction of it, between the coupling position KK and the uncoupling position EK. Thus, the coupling actuator 56 is formed as a lifting magnet actuator.

The drive motor 32 is preferably formed as a gear motor, which includes for example the mentioned electric motor and thus the stator and the rotor. The stator and the rotor are received in the housing 34 of the drive motor 32. Further, the gear motor for example includes a gear in particular received in the housing 34, via which the shaft 36 and thus the threaded spindle 42 is for example drivable by the rotor or by the electric motor.

Alternatively or additionally to the plastic bowls or alternatively or additionally to the support of the coupling actuator 56 on the housing 120 movable along the rotational axis 46, it can be provided that the drive motor 32 is supported on the housing 120 via a slider 122 movable along the rotational axis 46 and thus axially in relation to the housing 120 or also referred to as axial slider such that the drive motor 32 can for example be moved along the rotational axis 46 in relation to the housing 120, in particular by means of the coupling actuator 56. Thereby, the coupling element 60 and the entire drive motor 32 with it can be moved between the uncoupling position EK and the coupling position KK by means of the coupling actuator 56.

The coupling element 60 is a so-called drive part of the coupling since the coupling element 60 is drivable by the drive motor 32 and since the coupling element 58 is drivable by the drive motor 32 via the coupling element 60. Thus, the coupling element 58 is for example a driven part of the coupling. In addition, a catch 124 of the coupling is for example provided. Furthermore, at least one spindle bearing 126 is provided, by means of which the threaded spindle 42 is for example supported on the housing 120 and thus on the door 16 in its axial direction and/or in its radial direction. In particular, it can be provided that the spindle bearing 126 is formed as an axial spindle bearing. Alternatively or additionally, a spindle bearing 128 is provided, by means of which the threaded spindle 42 is supported on the housing 120 and thus on the door 16 in its axial direction and/or in its radial direction. In particular, the spindle bearing 128 can be formed as a radial spindle bearing. FIGS. 17 and 16 for example show the open position O of the door 16, while FIG. 18 for example illustrates the closed position S of the door 16. The opening element 76 is particularly well recognizable from FIG. 19, which for example penetrates a passage opening 130 of the housing 120, in particular of a leg 132 of the housing 120.

The invention claimed is:

1. An arrangement of a drive device on a door capable of being pivotably arranged on a housing of an appliance, in which the drive device formed for pivoting the door in relation to the housing is retained on the door, the arrangement comprising:

a hinge, which comprises at least one first hinge part attached to the door and at least one second hinge part attachable to the housing and coupled to the first hinge part in an articulated manner;

at least one drive motor;

at least one transmission element at least indirectly coupled to the hinge in an articulated manner, which is at least indirectly drivable by the drive motor for pivoting the hinge parts in relation to each other and thereby is rectilinearly movable in relation to the door to thereby pivot the door in relation to the housing; and a coupling device, which is switchable between at least one coupling state, in which the transmission element is coupled to the drive motor, and at least one uncoupling state, in which the transmission element is uncoupled from the drive motor;

wherein the coupling device comprises at least one coupling actuator provided in addition to the drive motor and at least one coupling element, which is movable between at least one coupling position effecting the coupling state and at least one uncoupling position effecting the uncoupling state in relation to the door by the coupling actuator.

2. The arrangement according to claim 1, wherein a first coupling element is movable in relation to a second coupling element of the coupling device by the coupling actuator cooperating with the corresponding second coupling element in a form-fit manner in the coupling position such that the transmission element is coupled to the drive motor at least in a form-fit manner in the coupling state.

3. The arrangement according to claim 2,
wherein
the threaded nut comprises at least two nut elements forming at least respective parts of the internal thread and movable in relation to each other, wherein at least one of the nut elements is formed as the first coupling element and the threaded rod is formed as the second coupling element.

4. The arrangement according to claim 1,
wherein
the transmission element is formed as a threaded nut, which comprises an internal thread as a first thread, wherein the drive device includes a threaded spindle corresponding to the threaded nut, which comprises an external thread corresponding to the internal thread as a second thread and is drivable by the drive motor and thereby rotatable around a rotational axis in relation to the door and in relation to the threaded nut, whereby the threaded nut is rectilinearly movable along the threaded spindle with form-fit cooperation of the threads.

5. The arrangement according to claim 4,
wherein
at least one angle sensor is provided, by which respective rotational positions of the threaded spindle can be captured, and/or that at least one linear sensor is provided, by which respective linear positions of the threaded nut along the threaded spindle can be captured.

6. The arrangement according to claim 1,
further comprising:
an opening aid, which comprises at least one opening element, which is movable, into supporting abutment on the housing in relation to the door and the housing, to thereby repel the door from the housing and thereby pivot it from a closed position to an open position.

7. The arrangement according to claim 6,
wherein
the opening element is rotationally fixedly connected to the drive motor, wherein the drive motor and the opening element are rotatable in relation to the door and rotate in a rotational direction in relation to the door upon pivoting the door to the open position to be effected by the torque provided by the drive motor, such that the opening element comes into supporting abutment on the housing, whereupon the torque provided by the drive motor can be supported on the housing via the opening element to thereby pivot the door to the open position by the torque.

8. The arrangement according to claim 7,
further comprising:
at least one stop provided on the door, wherein the drive motor and the opening element rotate further in the rotational direction in relation to the door upon further providing the torque occurring after pivoting the door to the open position effected by the torque such that the opening element and/or the drive motor come into supporting abutment on the stop, whereupon the torque provided by the drive motor can be supported on the stop, to thereby further open the door starting from the open position by the torque.

9. The arrangement according to claim 6,
wherein
the opening element is formed as a cam.

10. An arrangement of a drive device on a door capable of being pivotably arranged on a housing of an appliance, in which the drive device formed for pivoting the door in relation to the housing is retained on the door, the arrangement comprising:
a hinge, which comprises at least one first hinge part attached to the door and at least one second hinge part attachable to the housing and coupled to the first hinge part in an articulated manner;
at least one drive motor, by which at least one torque for pivoting the door can be provided;
at least one transmission element at least indirectly coupled to the hinge in an articulated manner, which is drivable by the torque provided by the drive motor for pivoting the hinge parts in relation to each other and thereby rectilinearly movable in relation to the door to thereby pivot the door in relation to the housing; and
an opening aid, which comprises at least one opening element, which is pivotable into supporting abutment on the housing in relation to the door and the housing to thereby repel the door from the housing and thereby pivot it from a closed position to an open position;
wherein
the opening element is rotationally fixedly connected to the drive motor, wherein the drive motor and the opening element are rotatable in relation to the door and rotate in a rotational direction in relation to the door upon pivoting the door to the open position to be effected by the torque provided by the drive motor, such that the opening element comes into supporting abutment on the housing, whereupon the torque provided by the drive motor can be supported on the housing via the opening element to thereby pivot the door to the open position by the torque.

11. The arrangement according to claim 10,
further comprising:
at least one stop provided on the door, wherein the drive motor and the opening element rotate further in the rotational direction in relation to the door upon further providing the torque occurring after pivoting the door to the open position effected by the torque such that the opening element and/or the drive motor come into supporting abutment on the stop, whereupon the torque provided by the drive motor can be supported on the stop, to thereby further open the door starting from the open position by the torque.

12. The arrangement according to claim 11,
wherein
the opening element is formed as a cam.

13. An arrangement of a drive device on a door capable of being pivotably arranged on a housing of an appliance, in which the drive device formed for pivoting the door in relation to the housing is retained on the door, the arrangement comprising:
a hinge, which comprises at least one first hinge part attached to the door and at least one second hinge part attachable to the housing and coupled to the first hinge part in an articulated manner;
at least one drive motor; and
at least one transmission element at least indirectly coupled to the hinge in an articulated manner, which is at least indirectly drivable by the drive motor for pivoting the hinge parts in relation to each other and thereby rectilinearly movable in relation to the door to thereby pivot the door in relation to the housing,
wherein
the transmission element is formed as a threaded nut, which comprises an internal thread as a first thread; and the drive device includes a threaded spindle corresponding to the threaded nut, which comprises an external thread corresponding to the internal thread as a second thread and is drivable by the drive motor and thereby rotatable around a rotational axis in relation to the door and in relation to the threaded nut, whereby the threaded nut is rectilinearly movable along the threaded spindle with form-fit cooperation of the threads.

14. The arrangement according to claim 13, wherein at least one angle sensor is provided, by which respective rotational positions of the threaded spindle can be captured.

15. The arrangement according to claim 13, wherein at least one linear sensor is provided, by which respective linear positions of the threaded nut along the threaded spindle can be captured.

* * * * *